United States Patent [19]

Ishii

[11] Patent Number: 4,780,938

[45] Date of Patent: Nov. 1, 1988

[54] SLIDE FASTENER SLIDER WITH DETACHABLE PULL TAB

[75] Inventor: Susumu Ishii, Kurobe, Japan

[73] Assignee: Yoshida Kogyo K. K., Tokyo, Japan

[21] Appl. No.: 134,709

[22] Filed: Dec. 18, 1987

[30] Foreign Application Priority Data

Dec. 19, 1986 [JP] Japan ..... 61-195522[U]

[51] Int. Cl.[4] ..... A44B 19/26

[52] U.S. Cl. ..... 24/429; 24/419

[58] Field of Search ..... 24/429, 419, 420, 236; 294/3.6

[56] References Cited

U.S. PATENT DOCUMENTS 3,320,645 5/1967 Burbank ..... 24/421
4,570,309 2/1986 Ishii ..... 24/429
4,624,032 11/1986 Ishii et al. ..... 24/429

FOREIGN PATENT DOCUMENTS 61-72209 5/1986 Japan .

*Primary Examiner*—Victor N. Sakran

[57] ABSTRACT

A slide fastener slider includes an arch-shaped lug having a rear free end spaced from the top surface of an upper wing by a first gap larger than the diameter of the spindle of a pull tab, and a closure member slidably mounted in the upper wing and having a first closure projection normally disposed adjacent to the rear free end of the lug to substantially close the first gap. In order to prevent objectionable lateral oscillation of the pull tab relative to the lug without increasing the stroke of the closure member, the lug has on its underside an intermediate partition wall spaced from the top surface of the upper wall by a second gap at least equal to the first gap, and the closure member has a second closure projection normally disposed adjacent to the partition wall to substantially close the second gap. When the closure member is moved forwardly to displace the first and second closure projections, respectively, from the rear free end and the partition wall, the pull tab spindle can pass through the first and second gaps.

12 Claims, 4 Drawing Sheets

SLIDE FASTENER SLIDER WITH DETACHABLE PULL TAB

BACKGROUND OF THE INVENTION

1. Field of the Invention

This application is related to my copending application, U.S. Ser. No. 134,750 filed on even date herewith).

The present invention relates generally to slide fasteners, and more particularly to a slide fastener slider having a detachable pull tab.

2. Prior Art

Japanese Utility Model Lajd-open Publication No. 61-72209 discloses a slide fastener slider having a detachable pull tab. The disclosed slider includes an arch-shaped lug projecting from the top surface of an upper wing and terminating in a rear free end spaced from the top surface of the upper wing by a gap greater than the diameter of a spindle of the pull tab, and a closure member slidably mounted in the upper wing for opening and closing the gap to detachably connect the pull tab to a body of the slider.

The known slider of the foregoing construction, however, is not fully satisfactory in that the cross-sectional area of the lug's rear free end A is considerably smaller than the area of an opening B in the pull tab C and hence the pull tab C is freely oscillatable about the spindle D in the lateral directions indicated by the arrows E, F shown in FIG. 9. If the pull tab C were laterally displaced during the sewing operation of a slide fastener having such slider G to an article such as a garment fabric or a bag, the displaced pull tab C would interfere with a sewing needle, thereby lowering the sewing efficiency and sometimes damaging or otherwise breaking the sewing needle.

Such lateral displacent or oscillation of the pull tab C will not occur when the lug's rear free end A and the closure member H are elongated in the longitudinal direction of the slider G to such an extent that the opening B in the pull tab C is substantially filled with the elongated rear free end A and the elongated closure member H, as shown in FIG. 10. With this elongation of the rear free end A, the stroke I of the closure member H must be long enough to open and close the gap between the elongated rear free end A and the upper wing of the slider body J. In practice, however, the stroke I of the closure member H is restricted to a small extent so as not to lower the mechanical strength of the slider body J.

SUMMARY OF THE INVENTION

With the foregoing difficulties in view, it is an object of the present invention to provide a slide fastener slider having a detachable pull tab in which the pull tab is stably mounted on a slider body without causing objectionable lateral displacement or oscillation.

Another object of the present invention is to provide a slide fastener slider having a detachable pull tab which is automatically assembled on a slider body.

A further object of the present invention is to provide a slide fastener slider having a closure member which has a relatively small stroke and hence does not lower the mechanical strength of the slider body.

According to the present invention, a slide fastener slider includes an arch-shaped lug having a rear free end spaced from the top surface of an upper wing by a first gap larger than the diameter of the spindle of a pull tab, and a closure member slidably mounted in the upper wing and having a first closure projection normally disposed adjacent to the rear free end of the lug to substantially close the first gap. The lug has on its underside an intermediate partition wall spaced from the top surface of the upper wall by a second gap at least equal to the first gap, and the closure member has a second closure projection normally disposed adjacent to the partition wall to substantially close the second gap. When the closure member is moved forwardly to displace the first and second closure projections, respectively, from the rear free end and the partition wall, the pull tab spindle can pass through the first and second gaps. With this construction, the objectionable lateral oscillation of the pull tab relative to the lug is prevented without increasing the stroke of the closure member.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
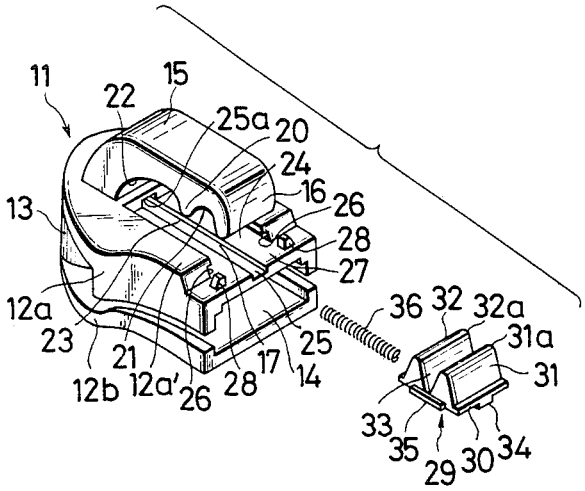
FIG. 1 is an exploded perspective view of a slide fastener slider embodying the present invention.
Figure 2:
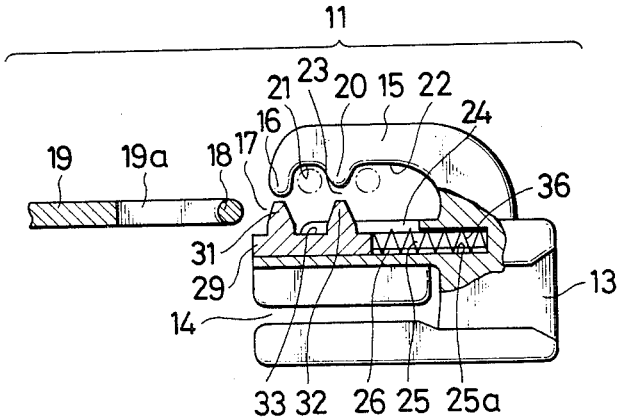
FIG. 2 is a side elevational view, partly in cross section, of the slider shown in FIG. 1 before it is assembled.
Figure 3:
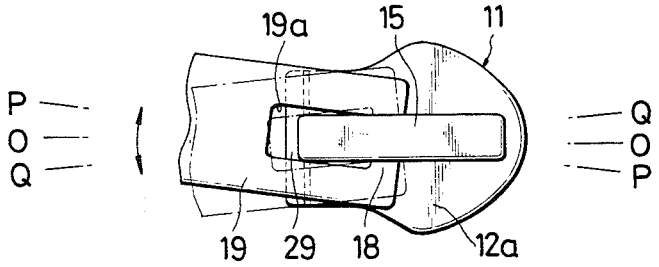
FIG. 3 is a schematic plan view of the slider after it has been assembled.

FIGS. 1 through 3 show a first embodiment of slide fastener slider according to the present invention. The slider 11 includes a slider body having upper and lower wings 12*a*, 12*b* joined at their front ends by a neck 13 so as to define therebetween a generally Y-shaped guide channel 14 for the passage therethrough of a pair of opposed rows of coupling elements of a slide fastener (not shown). The slider body is made by die-casting and has an arch-shaped lug 15 integral therewith and disposed on the top surface 12*a*′ of the upper wing 12*a*. The arch-shaped lug 15 extends from the front end of the upper wing 12*a* and terminates in a downwardly directed rear free end 16 spaced from the top surface 12*a*′ of the upper wing 12*a* by a predetermined gap 17 larger than the diameter of a spindle 18 of a pull tab 19. The pull tab 19 has a rectangular opening 10*a* for being threaded over the lug 15, the opening 19*a* being partly defined by the spindle 18.

The arch-shaped lug 15 has on its underside an intermediate partition wall 20 disposed between the front and rear ends of the lug 15 and extending transversely across the width of the lug 15 so that there are two adjacent, downwardly open recesses 21, 22 defined on opposite sides of the partition wall 20. The partition wall 20 is spaced from the top surface 12*a'* of the upper wall 12*a* by a gap 23 which is greater than the diameter of the pull tab spindle 18. The first recess 21 disposed adjacent to the rear free end 16 serves to temporarily receive the spindle 18 of the pull tab 19 before the spindle 18 is mutually received in the second recess 22 desposed adjacent to the front end of the lug 15.

The slider body has a recessed portion 24 extending longitudinally in the top surface 12*a'* of the upper wing 12*a* from its rear end and terminating short of the fixed front end of the lug 15. The recessed portion 24 has a central guide groove 25 formed in the bottom wall of the recessed portion 24 and extending in a longitudinal central axis of the slider body, and a pair of lateral guide grooves 26, 26 extending in and along the opposite side walls of the recessed portion 24. The central guide groove 25 has an end extension 25*a* extending in the upper wing 12*a* below the front end of the lug 15 and terminating short of the front end of the upper wing 12*a*.

The top surface 12*a'* of the upper wing 12*a* has a cutout 27 extending transversely along the rear end of the upper wing 12*a* and lying flush with the bottom surface of the recessed portion 24, and a pair of laterally spaced stopper projections 28, 28 disposed on the cutout 27 adjacent to the rear end of the upper wing 12*a*. The stopper projections 28 are slightly displaced laterally outwardly from the lateral guide grooves 25.

The slider body further includes a closure member 29 slidably mounted in the recessed portion 24. The closure member 29 includes a rectangular base 30 slidably received in the recessed portion 24, and a pair of parallel spaced closure projections 31, 32 integral with the base 30 and extending transversely of the longitudinal axis of the slider body. The closure projections 31, 32 are tapered and define therebetween an upwardly flared triangular recess 33. The tapered closure projections 31, 32 have respective top edges 31*a*, 32*a* spaced from one another by a distance which is equal to the distance between the rear free end 16 of the lug 15 and the partition wall 20. The closure member 29 further has a central guide ridge 34 extending longitudinally on the underside of the base 30 and slidably fitted in the central guide groove 25 in the upper wing 12*a*, and a pair of lateral guide ridges 35 (only one shown in FIG. 1) extending on the opposite side surfaces of the base 30 and slidably fitted in the lateral guide grooves 26 in the upper wing 12*a*. A resilient member comprising a compression coil spring 36 is disposed in the central guide groove 25 with part received in the end extension 25*a*. The spring 36 acts between the slider body and the closure member 29 to normally urge the closure member 29 toward the rear end of the slider body. The rearward movement of the closure member 29 is restricted by a pair of stops (not shown but described later on) engaging the rear ends of the respective lateral guide ridges 35 of the closure member 29.

In production, the slider body is made by die-casing and initially has the two stopper projections 28 (FIG. 1) adjacent to the rear end of the upper wing 12*a*. As described above, the stopper projections 28 are displaced laterally outwardly out of alignment with the lateral guide grooves 26 in the upper wing 12*a*. Then, after the spring 36 and the closure member 29 have been inserted in the recessed portion 24, the stopper projections 28 are deformed or bent laterally inwardly into paths of movement of the lateral guide ridges 35 to thereby provide the respective stops. In this instance, the closure member 29 is held in a closed position (FIG. 2) in which the closure projections 31, 32 are disposed in vertical alignment with the rear free end 16 of the lug 15 and the partition wall 20, respectively, with slight spaces therebetween. Subsequently, the closure member 29 is moved from its closed position to its open position (not shown) aginst the bias of the spring 36 by simply pushing the closure projection 31 by the spindle 18 of the pull tab 19 until the closure projection 31 is brought into vertical alignment with the partition wall 20. The pull tab spindle 18 has now threaded through the gap 17 into the first recess 21 in the lug 15, whereupon the closure member 29 returns to its closed position (FIG. 2) under the force of the spring 36 in which position the pull tab spindle 19 is temporarily received in a space formed jointly by the first recess 21 in the lug 15 and the recess 33 in the closure member 29. Thereafter, the pull tab 19 is pushed again to displace the closure projection 32 forwardly against the bias of the spring 36 until the gap 23 is opened, whereupon the pull tab spindle 18 enters the second recess 22 in the lug 15. Thus, the pull tab 19 is threaded on the lug 15 with its spindle 18 received in the second recess 22. The closure member 29 is returned again to its closed position in which the closure projection 32 is disposed in vertical alignment with the partition wall 20 to thereby prevent the pull tab 19 from accidental removal from the lug 15.

The lateral oscillation of the pull tab 19 is theoretically avoidable or restricted to a negligible extent, but in practice, due to cumulated manufacturing tolerance, the pull tab 19 is slightly oscillatable within an angle defined between two chain lines P—P and Q—Q with respect to the longitudinal center line O—O of the slider body, as shown in FIG. 3. Such angle of lateral oscillation is very small and hence does not affect the sewing operation of a slide fastener having the slider 11 to an article such as a garment fabric or a bag (not shown).

To detach the pull tab 19 from the slider 11, the closure member 29 is manually moved forwardly against the force of the spring 36 from the closed position of FIG. 2 to the non-illustrated open position in which the closure projections 31, 32 are spaced respectively from the free end 16 and the partition wall 20 to allow the spindle 18 of the pull tab 19 to pass successively through the gap 23 and the gap 17.

Figure 4:
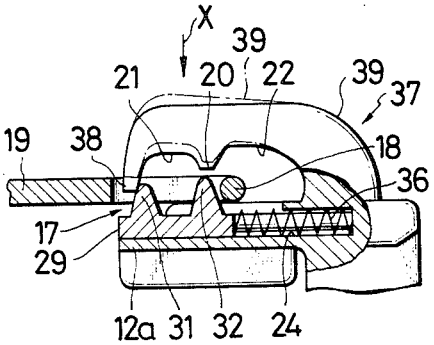
FIG. 4 is a fragmentary side elevational view showing a modified slide fastener slider.

A modified slider 37 shown in FIG. 4 is similar to the slider 11 of the foregoing embodiment but differs therefrom in that the rearward movement of the closure member 29 is restricted by the rear free end 38 of a lug 39, instead of the stops (cf. the stopper projections 28 shown in FIG. 1). As the closure member 29 is disposed in closed position, the first closure projection 31 is disposed against the inner side of the lug's rear free end 38 under the bias of the spring 36. In production, the gap between the free end 38 of the lug 39 and the top surface of the upper wing 12*a* is initially large enough to allow the closure member 29 to be inserted into the recessed portion 24, at which time the closure projections 31, 32 can pass the free end 38 of the lug 39, as indicated by the phantom lines in FIG. 4. After the closure member 29 and the spring 36 are inserted in the recessed portion 24 until the closure projection 31 has passed the lug's free end 38, the lug 39 is deformed or bent downwardly by a force applied thereto as indicated by the arrow X in such a manner that the free end 38 of the lug 39 is disposed below the top end of the closure projection 31 and is spaced from the top surface of the upper wing 12*a* by the predetermined gap 17 larger than the diameter of the spindle 18. In this instance, the closure projection 32 is disposed beneath the partition wall 20 on the lug 39.

Figure 5:
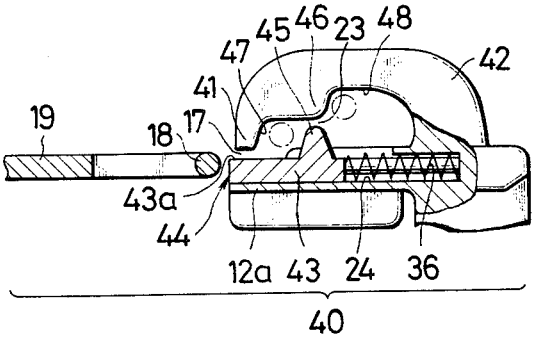
FIG. 5 is a view similar to FIG. 4, but showing another modified form of slider.

FIG. 5 is a view similar to FIG. 2, but showing a slider 40 which differs from the slider 11 in that the free end 41 of an arch-shaped lug 42 is downwardly extended to a position close to the top surface 43*a* of a base 43 of a closure member 44, and the closure member 44 has only one closure projection 45 confronting a partition wall 46 on the lug 42. The partition wall 46 is rearwardly flattened to provide a shoulder so that there are two adjacent recesses 47, 48 defined in the underside of the lug 42, respectively, between the free end 41 and the partition wall 46 and between the partition wall 46 and the front fixed end of the lug 42. In production, the gap between the free end 41 of the lug 42 and the top surface of the upper wing 12*a* is initially large enough to allow the closure member 44 to be inserted into the recessed portion 24, at which time the closure projection 45 can pass the free end 41 of the lug 42. After the closure member 44 together with the spring 36 is inserted in the recessed portion 24 until the closure projection 45 is disposed beneath the partition wall 46 to substantially close the gap 23, the stopper projections (identical with the projections 28 shown in FIG. 1) are deformed to provide the stops, thereby retaining the closure member 44 in its closed position. Then, the lug 42 is deformed or bent downwardly to the position shown in FIG. 3, in which the free end 41 of the lug 42 is located immediately above the top surface 43*a* of the base 43 and is spaced from the top surface of the upper wing 12*a* by the predetermined gap 17 larger than the diameter of the spindle 18 of the pull tab 19.

Figure 6:
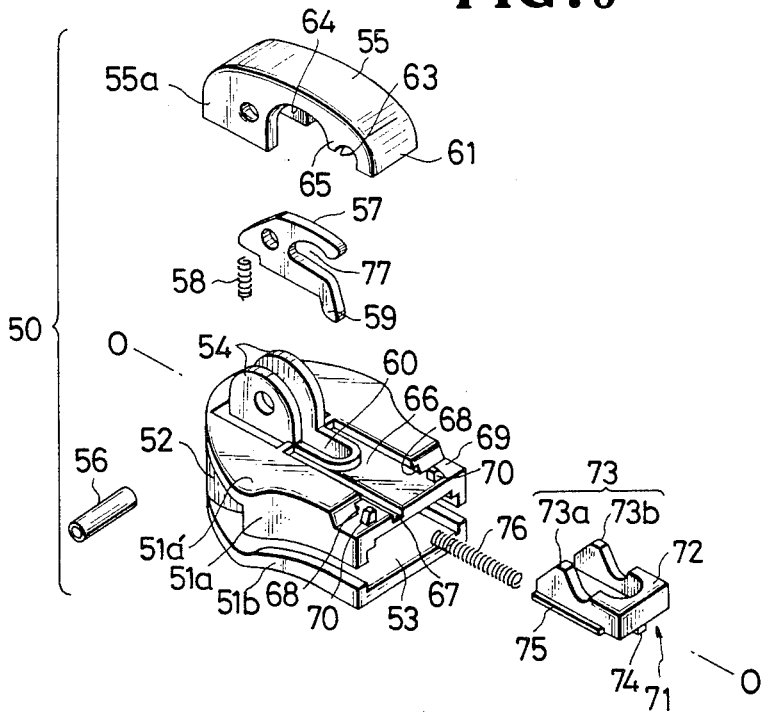
FIG. 6 is an exploded perspective view, with parts omitted for clarity, of an automatically lockable slider according to the invention.
Figure 7:
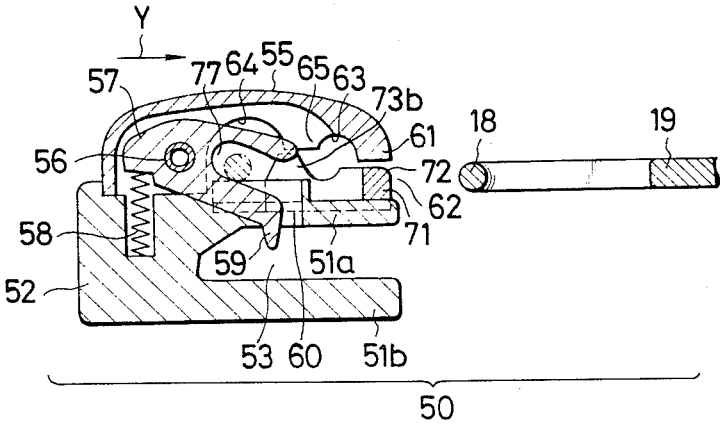
FIG. 7 is a longitudinal cross-section view of the slider shown in FIG. 6.

FIGS. 6 and 7 show an automatically lockable slider 50 having a detachable pull tab 19 (FIG. 7). The slider 49 includes a slider body having upper and lower wings 51*a*, 51*b* joined at one end by a neck 52 so as to define therebetween a generally Y-shaped guide channel 53 for the passage therethrough of a pair of opposed rows of coupling elements of a slide fastener (neither shown). The slider body is made by die-casing and has a pair of spaced upstanding supports 54 integral therewith and disposed on the top surface 51*a*' of the upper wing 51*a* adjacent to the front end thereof. The slider body also includes an arch-shaped hollow lug 55 disposed over and around the supports 54 and secured at its front end 55*a* to the supports 54 by means of a tubular horizontal pin 56. A generally C-shaped locking member 57 is vertically disposed between the supports 54 and has a front end pivotably supported on the pin 56. The locking member 57 is normally urged by a compression coil spring 58 to turn clockwise about the pin 56 into its locking position shown in FIG. 7 in which a locking prong 59 projects through an aperture 60 in the upper wing 51*a* into the guide channel 53 to lock the slider 49 in position on the rows of coupling elements.

The arch-shaped hollow lug 55 has a rear free end 61 spaced from the top surface 51*a*' of the upper wing 51*a* by a predetermined gap 62 (FIG. 7) larger than the diameter of a spindle 18 of the pull tab 19. The lug 55 has a pair of longitudinally spaced arcuate recesses 63, 64 separated by a pair of laterally spaced partition walls 65 (only one shown).

The slider body has a recessed portion 66 extending longitudinally in the top surface 51*a*' of the upper wing 51*a* from its rear end to the rear ends of the respective supports 54. The recessed portion 66 has a longitudinal guide groove 67 extending in the bottom wall of the recessed portion 66, and a pair of lateral guide grooves 68 extending in and along the opposite side walls of the recessed portion 66. The guide groove 67 is laterally displaced out of alignment with the longitudinal center line O—O of the slider 50, as shown in FIG. 6.

The top surface 51*a*' of the upper wing 51*a* has a transverse cutout 69 extending along the rear end of the upper wing 51*a*. A pair of stopper projections 70, 70 is disposed on the cutout 69 adjacent to the rear end of the slider body. Each of the stopper projections 70 is displaced laterally outwardly from the corresponding lateral guide groove 68.

The slider body further has a generally U-shaped closure member 71 slidably mounted in the recessed portion 66 of the upper wing 51*a*. The closure member 71 has a pair of closure portions 72, 73 disposed at opposite ends thereof. The first closure portion 72 is in the shape of a flat land extending around the rear end of the closure member 71. The second closure portion 73 includes a pair of laterally spaced closure projections 73*a*, 73*b* disposed on the front end of the closure member 71. The first and second closure portions 72, 73 are spaced from one another by the distance substantially equal to the distance between the free end 61 and the partition walls 65 of the lug 55. The closure member 71 further has a longitudinal guide ridge 74 on its bottom surface, and a pair of elongated lateral guide ridges 75 (only one shown) on its opposite side surfaces. The guide ridges 74, 75 are slidably fitted in the guide grooves 67, 68, respectively. A compression coil spring 76 (FIG. 6) is disposed in the guide groove 67 and acts between the slider body and the closure member 71 to normally urge the closure member 71 toward the rear end of the slider body. The rearward movement of the closure member 71 is restricted by a pair of stops (not shown but described later on) engaging the lateral guide ridges 75 on the closure member 71.

In assembly, the spring 76 and the closure member 71 are inserted in the recessed portion 66 of the upper wing 5 and then the stopper projections 70 are bent inwardly in the paths of movement of the lateral guide ridges 75 to thereby provide the respective stops. Then, after the locking member 57 is disposed between the supports 54 with the spring 58 interposed between the slider body and the front end of the locking member 57, the lug 55 is disposed over the supports 54 and the locking member 57 and then the pin 56 is threaded through the lug 55, the supports 54 and the locking member 57 to pivotably connect the locking member 57 to the supports 54 and the lug 55. In this instance, the closure member 71 is disposed in a closed position (FIG. 7) in which the first and second closure portions 72, 73 are held in vertical alignment respectively with the free end 61 and the partition walls 65 with slight spaces therebetween. Subsequently, the closure member 71 is moved forwardly from its closed position to its open position against the bias of the spring 76 by simply pusing the first closure portion or land 72 by the spindle 18 of the pull tab 19 until the closure land 72 is brought into vertical alignment with the partition walls 65. The pull tab spindle 18 has now threaded into the recess 63 adjacent to the free end 61 through the gap 62 between the free end 61 and the top surface 51*a*' of the upper wing 51*a*, whereupon the closure member 71 is returned to its closed position by the force of the spring 76. Thereafter, the pull tab 19 is pushed again until the closure projection 73*a*, 73*b* are displaced forwardly by the spindle 18 out of vertical alignment with the partition walls 65, whereupon the spindle 18 is received in a rearwardly opening notch 77 in the locking member 57. Then the closure member 71 returns again to its closed position to thereby prevent the pull tab 19 from accidental removal from the slider body. When the pull tab 19 is pulled in the direction indicated by the arrow Y shown in FIG. 7, the locking member 57 is turned counter-clockwise about the pin 56 to retract the locking prong 59 from the guide channel 53 into the aperture 60, thereby releasing the slider 50 from the locking engagement with the coupling elements.

Figure 8:
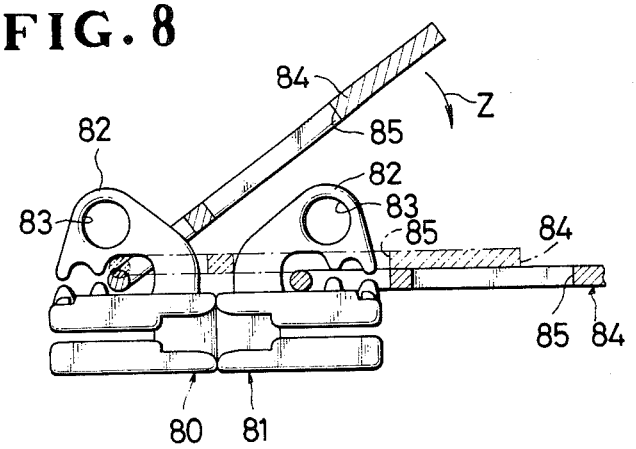
FIG. 8 is a side elevational view, partly in cross section, of a pair of opposed padlockable sliders according to another embodiment.
Figure 9:
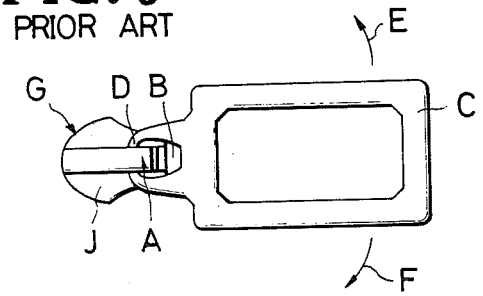
FIG. 9 PRIOR ART
FIG. 9 is a plan view of a known slider.
Figure 10:
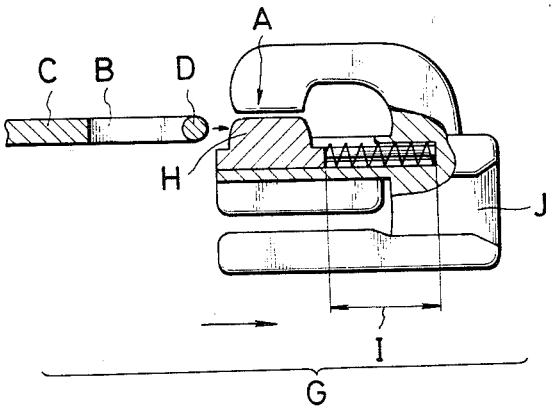
FIG. 10 is a side elevational view of a slider, illustrative of a possible but still unsatisfactory modification of the known slider.

FIG. 8 shows a pair of padlockable slide fastener sliders 80, 81 mounted on a non-illustrated slide fastener in face-to-face confrontation to one another. The sliders 80, 81 are structurally and functionally the same as the slider 11 of the first-mentioned embodiment with the exception that the arch-shaped lug 82 larger in height than the lug 15 of the slider 11 has a horizontal hole 83 through which the shackle of a padlock (not shown) is inserted, and the pull tab 84 has an aperture 85 receptive of the lug 82 of another slider 80 or 81. To lock the two sliders 80, 81, the pull tab 84 of the first slider 80 is overturned toward the second slider 81 as indicated by the arrow Z until it lies flatwise against the pull tab 84 of the second slider, with the lug 82 on the second slider 81 projecting upwardly through the aperture 85 in the pull tab 84 of the first slider 80. Then, after the shackle of the padlock is threaded through the hole 83 of the second slider 81, the padlock is closed to hold the first and second sliders 80, 81 in locked condition. Because the pull tabs 84 of the sliders 80, 81 can maintain their proper orientation relative to the lugs 82 without causing undue lateral oscillation, the foregoing locking operation is achieved reliably with utmost ease.

In any of the embodiments described above, objectionable lateral oscillation of the pull tab relative to the lug is prevented without increasing the stroke of the closure member because the effective cross-sectional aear of a pull tab retaining portion (namely, the rear free end of the lug and the closure projection of the closure member) is enlarged due to the provision of the intermediate partition wall on the lug and the second closure projection on the closure member. The pull tab retaining portion thus enlarged occupies the major portion of the mating aperture in the pull tab, thereby limiting the lateral oscillation of the pull tab to a negligible extent. Since the first and second gaps are opened concurrently upon displacent of the closure projections from the partition wall and the rear free end of the lug, the stroke of the closure member is not increased.

Obviously, various modifications and variations of the present invention are possible in the light of the above teaching. It is therefoere to be understood that within the scope of the appended claims the invention may be practiced otherwise than as specifically described.

What is claimed is:

1. A slider for a slide fastener having a pair of opposed rows of coupling elements, comprising:

(a) a slider body including upper and lower wings joined at their front ends by a neck so as to define therebetween a generally Y-shaped guide channel for the passage of the opposed coupling element rows;

(b) an arch-shaped lug projecting from the front end of said upper wing over a top surface of said upper wing and terminating in a rear free end directed toward said top surface and spaced therefrom by a first gap, said lug having on its underside an intermediate partition all directed toward said top surface of said upper wing and spaced therefrom by a second gap at least equal to said first gap, said lug further having first and second recesses defined respectively between said rear free end and said partition wall and between said partition wall and a front fixed end of said lug;

(c) a pull tab threaded onto said arch-shaped lug for pivotal movement relative to said slider body and having a spindle;

(d) a closure member slidably mounted in said upper wing and having a pair of spaced first and second closure portions, said closure member being movable longitudinally of said slider body between an open position in which said first and second closure portions are spaced respectively from said rear free end and said partition wall of said lug so as to allow said spindle of said pull tab to pass through said first and second gaps, and a closed position in which said first and second closure portions are disposed adjacent to said rear free end and said partition wall of said lug to prevent said spindle of said pull tab from passing through said first and second gaps; and (e) a spring mounted in said upper wing to normally urge said closure member toward said closed position.

2. A slider according to claim 1, said slider body having a recessed portion extending longitudinally in said top surface of said upper wing from its rear end toward said front fixed end of said lug, a first guide groove extending longitudinally in a bottom wall of said recessed portion, and a pair of second guide grooves extending longitudinally in opposite side walls of said recessed portion, said closure member being slidably mounted in said recessed portion and having a first guide ridge slidably fitted in said first guide groove and a pair of second guide ridges slidably fitted respectively in said second guide grooves, said spring being disposed in said first guide groove.

3. A slider according to claim 2, said arch-shaped lug being hollow, said slider body further having a locking member pivotably mounted in said hollow lug and angularly movable in a vertical plane extending in a longitudinal central axis of said slider body into and out of said guide channel for releasably locking the slider in position on the opposed coupling element rows, said first guide groove being laterally displaced from the longitudinal central axis of said slider body.

4. A slider according to claim 2, said slider body having at least one stop disposed adjacent to the rear end of said upper wing and engageable with one of said second guide ridge for preventing said closure member from being removed from said recessed portion.

5. A slider according to claim 2, said first guide groove having an end extension extending below said front fixed end of said lug.

6. A slider according to claim 1, said first and second closure portions being disposed in vertical alignment, respectively, with said rear free end and said partition wall of said lug when said closure member is disposed in said closed position.

7. A slider according to claim 6, said first and second closure portions comprising first and second closure projections disposed on a top surface of said closure member.

8. A slider according to claim 6, said first closure portion comprising a top surface of said closure member, said second closure portion comprising a closure projection disposed on said top surface of said closure member.

9. A slider according to claim 7, said first and second closure projections extending beyond said top surface of said upper wing to an extent slightly smaller than said first and second gaps.

10. A slider according to claim 2, said first and second closure portions comprising first and second closure projections disposed on a top surface of said closure member, said first closure projection being disposed against said rear free end of said lug under the bias of said spring when said closure member is disposed in said closed position.

11. A slider according to claim 10, said second closure projection being disposed in vertical alignment with said partition wall and extending beyond said top surface of said upper wing to an extent slightly smaller than said second gap, said first closure projection extending beyond said top surface of said upper wing to an extent larger than said first gap.

12. A slider according to claim 1, for use in a padlockable slide fastener having two identical sliders disposed in face-to-face confrontation to one another, said pull tab of each respective slider having an elongated aperature receptive of the lug of the opposite slider when said pull tab lies flatwise against the pull tab of the opposite slider, said lug of the opposite slider having a hole through which a shackle of a padlock extends for connecting the two sliders.

* * * * *